United States Patent [19]

Moeller

[11] Patent Number: 5,030,929

[45] Date of Patent: Jul. 9, 1991

[54] COMPACT WAVEGUIDE CONVERTER APPARATUS

[75] Inventor: Charles P. Moeller, Del Mar, Calif.

[73] Assignee: General Atomics, San Diego, Calif.

[21] Appl. No.: 462,377

[22] Filed: Jan. 9, 1990

[51] Int. Cl.[5] ..... H01P 1/16

[52] U.S. Cl. ..... 333/21 R; 315/4; 333/251

[58] Field of Search ..... 333/21 R, 113, 248, 333/251; 315/4, 5

[56] References Cited

U.S. PATENT DOCUMENTS

| | | | |
|---|---|---|---|
| 3,411,116 | 11/1968 | Boutelant | 333/21 R X |
| 4,523,127 | 1/1985 | Moeller | 315/4 |
| 4,604,551 | 8/1986 | Moeller | 315/4 |
| 4,636,689 | 1/1987 | Mourier | 315/4 |
| 4,680,558 | 7/1987 | Ghosh et al. | 333/21 R |
| 4,704,589 | 11/1987 | Moeller | 333/113 |

FOREIGN PATENT DOCUMENTS

| | | | |
|---|---|---|---|
| 2543368 | 9/1984 | France | 333/21 R |

OTHER PUBLICATIONS

Quine, J. P., "Oversize Tubular Metallic Waveguides," *Microwave Power Engineering*, vol. 1, Section 3.2, (Academic Press, New York, Ed. E. C. Okress, 1968).

Smith, Robert B., "Analytic Solution for Linearly Tapered Directional Couplers," J. Opt. Soc. Am., vol. 66, No. 9, pp. 882–892, (Sep. 1976).

Moeller et al., "Electron Cyclotron Heating Experiments in the JFT-2 Tokamok Using an Inside Launch Antenna," *Phys. Fluids*, 25(7), pp. 1211–1216, (Jul. 1982).

Vlasov et al., "Transformation of a Whispering Gallery Mode, Propagating in a Circular Waveguide, into a Beam of Waves," *Radio Eng. and Electron Phys.*, vol. 20, No. 10, pp. 14–17, (1975).

Doane, J. L., "Mode Converters for Generating the HE 11, (gaussian-like) Mode from TE 01 in a Circular Waveguide," *Int. J. Electronics*, vol. 53, No. 6, pp. 573–585, (1982).

Doane, J. L., "Low Loss Propagation in Corrugated Rectangular Waveguide at 1 mm Wavelength," *Int'l J. of Infrared and Millimeter Waves*, vol. 8, No. 1, pp. 13–27, (1987).

(List continued on next page.)

*Primary Examiner*—Paul Gensler

*Attorney, Agent, or Firm*—Fitch, Even, Tabin & Flannery

[57] ABSTRACT

Conversion from a whispering gallery or volume mode to a more useable mode, such as the $HE_{1,1}$ mode is achieved in a waveguide mode converter that includes input and output sections. The input section includes overlapping circular and coaxial waveguides. Microwave energy in a whispering gallery or volume mode within the circular waveguide is coupled through an array of N equally spaced axial slots placed in the common wall separating the circular waveguide and the coaxial waveguide to coaxial TE and TM modes. Helical grooves placed in one of walls of the coaxial waveguide convert the coaxial mode to a quasi parallel plate mode wherein the common wall separating the inner circular waveguide from the outer coaxial waveguide functions as one plate, and the outer wall of the coaxial waveguide functions as the other plate. The quasi parallel plate mode propagates microwave energy spirally through the coaxial waveguide in a direction k, where k makes an angle $\theta$ to the waveguide axis. The helical grooves are placed transverse to k. Such grooves cause the normal modes to no longer be the coaxial TE and TM modes, but modified linear combinations thereof. One such linear combination is a desired $TE_{0,1}$ mode, which normal mode is only slightly affected by the grooves. The other normal mode is analogous to the parallel plate $TM_{0,1}$ mode, which mode is strongly affected by the grooves. The output section extracts the $TE_{0,1}$ energy by helically unwinding the walls of the coaxial waveguide. Additional conversion to the $HE_{1,1}$ mode is accomplished by using a compact configuration that makes the wavefront cylindrical using a lens or mirror coupled to a sectoral horn.

30 Claims, 4 Drawing Sheets

OTHER PUBLICATIONS

Doane, J. L., "Low-Loss Twists in Oversized Rectangular Waveguide," *IEEE Transactions of Microwave Theory and Techniques*, vol. 36, No. 6, pp. 1033-1042, (Jun. 1988).

Doane et al., "Oversized Rectangular Waveguides with Mode-Free Bends and Twists for Broad Band Applications," *Microwave Journal*, vol. 32, No. 3, p. 153, Mar. 1989.

Marcuvitz, N., *Waveguide Handbook*, McGraw-Hill, pp. 62-80, (1951).

*Electronics Designers' Handbook*, 24th Edition, (McGraw-Hill, 1977), pp. 8-36 and 8-37.

FIG. 3A
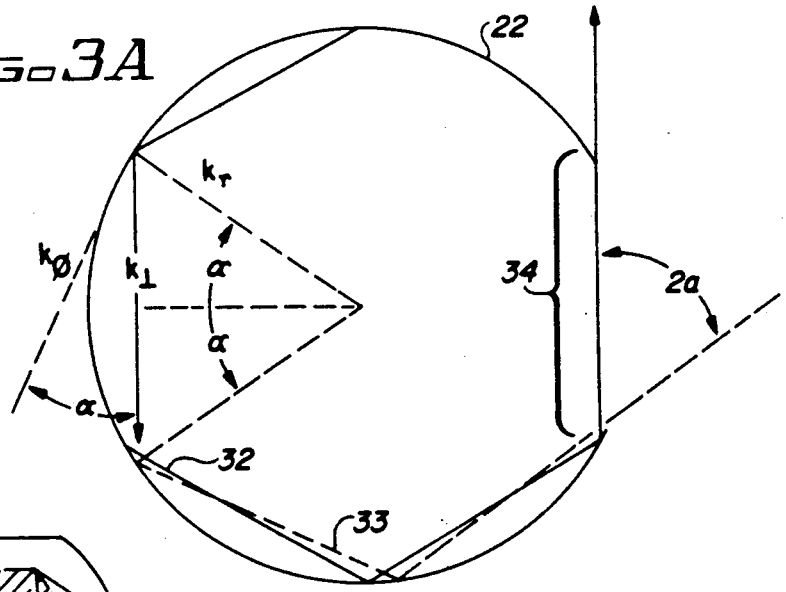
FIG. 3B
(PRIOR ART)
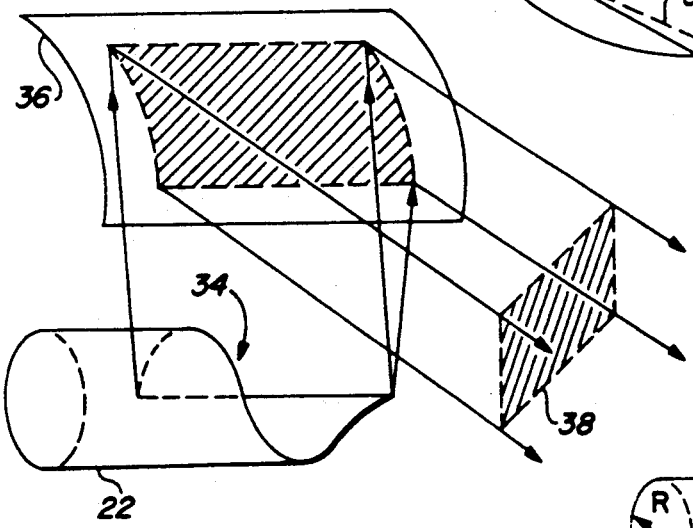
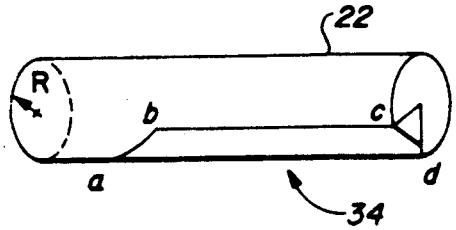
FIG. 4A
(PRIOR ART)
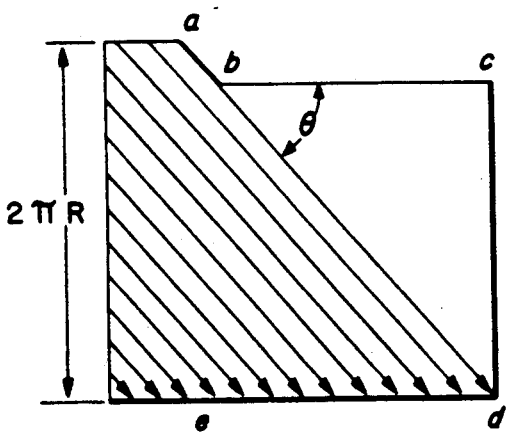
FIG. 4B
(PRIOR ART)
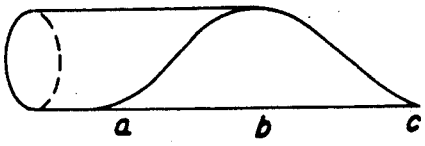
FIG. 4C
(PRIOR ART)

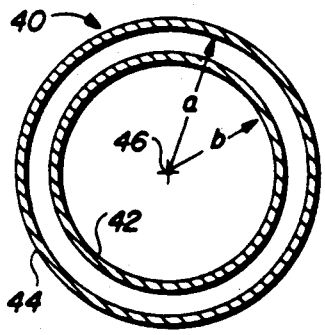
FIG. 5A
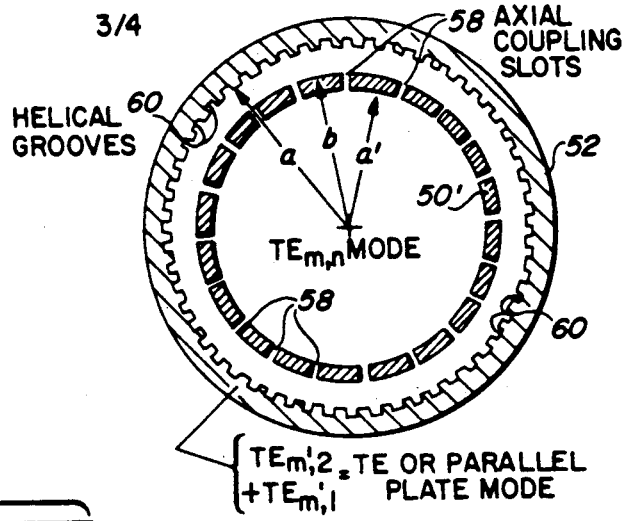
FIG. 5C
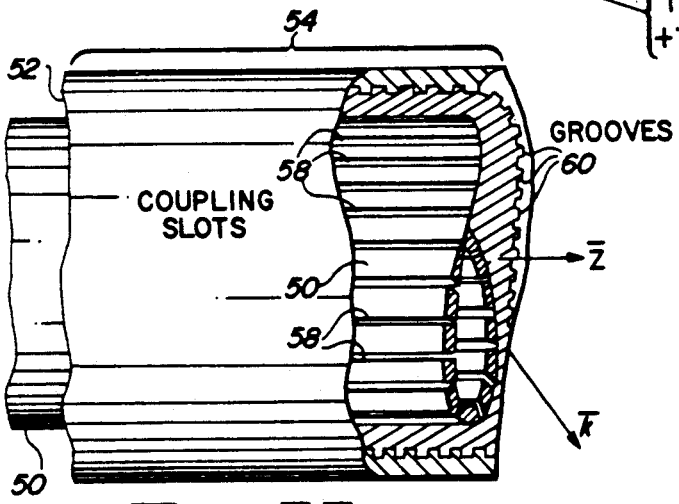
FIG. 5B
FIG. 6B
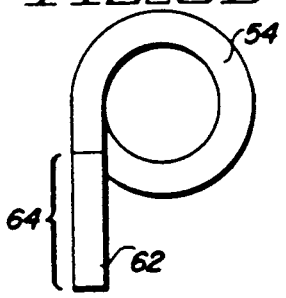
FIG. 6A
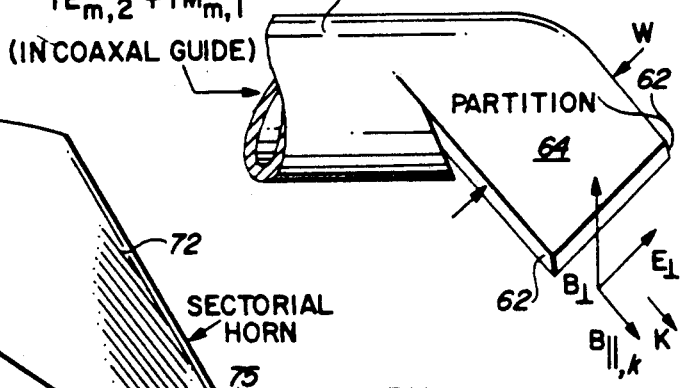
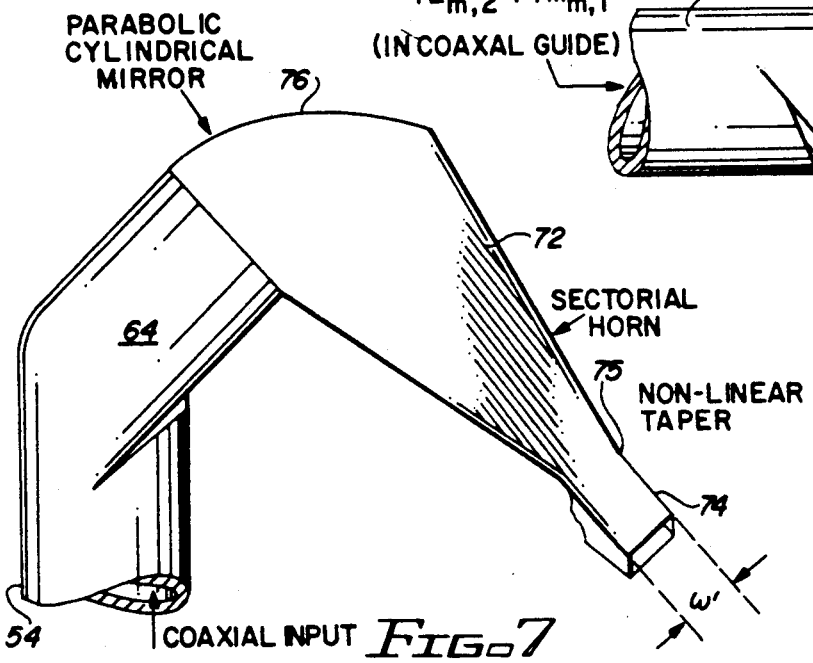
FIG. 7

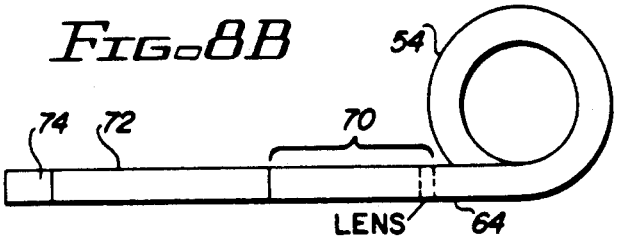
FIG. 8B
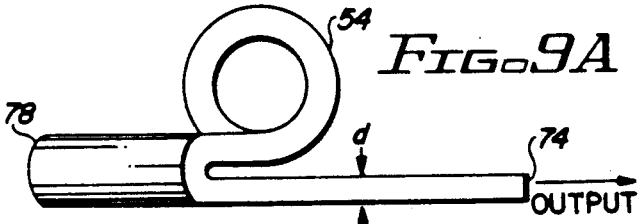
FIG. 9A
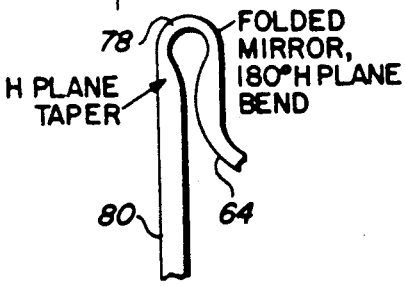
FIG. 9C
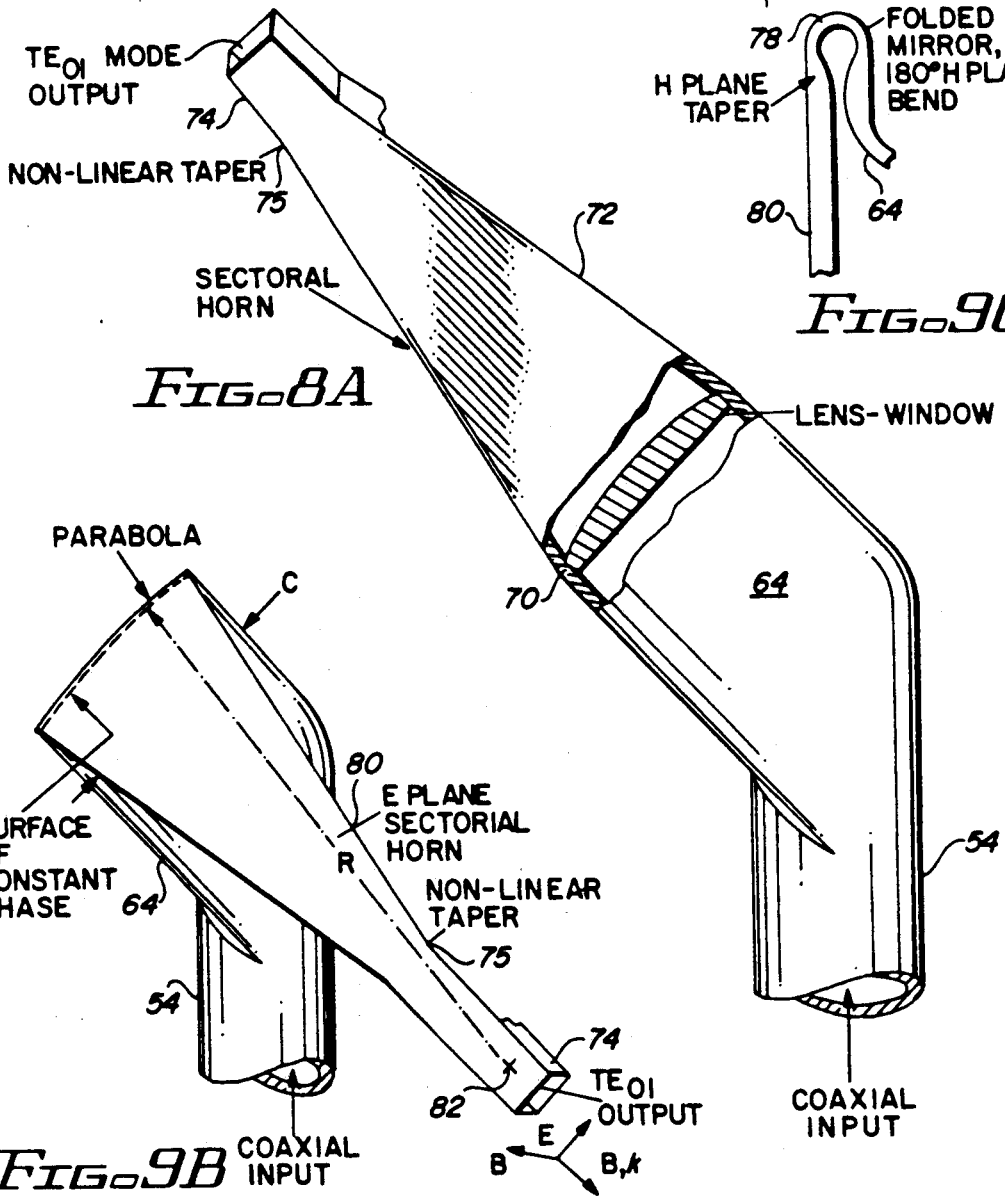
FIG. 8A
FIG. 9B

COMPACT WAVEGUIDE CONVERTER APPARATUS

BACKGROUND OF THE INVENTION

The present invention relates generally to microwave waveguide converter apparatus and methods for efficiently converting microwave energy from modes having large angular mode numbers, e.g., whispering gallery modes or volume modes, to the $HE_{1,1}$ mode, or to modes that can be readily converted to the $HE_{1,1}$ mode or equivalent modes.

Waveguides are a form of transmission line used to transmit electromagnetic energy efficiently from one point to another. Waveguide modes are denominated to identify the distribution of the electric and magnetic fields within the waveguide. As indicated in the art, e.g., *Electronics Designers' Handbook,* 24 Edition (McGraw-Hill 1977) at page 8-36; or Marcuvitz, N., *Waveguide Handbook,* McGraw-Hill, pp. 72-80 (1951), specific modes are indicated by symbols such as $TE_{m,n}$ and $TM_{m,n}$. TM indicates that the magnetic field is everywhere transverse to the axis of the transmission line, i.e., the longitudinal axis of the waveguide. TE indicates that the electric field is everywhere transverse to the axis of the waveguide. For rectangular waveguides, the subscripts m and n denote the number of half period variations of the fields occurring within the waveguide in the two transverse dimensions. For circular waveguides, the subscript m denotes the number of full-period variations of the transverse component of field in the angular direction, and is frequently referred to as the angular mode number, while the subscript n denotes the number of half-period variations of the transverse component of field in the radial direction. A circular waveguide mode having no angular dependence may thus be either a $TE_{0,n}$ or a $TM_{0,n}$ mode, where n is any integer. It is noted that the $HE_{1,1}$ mode, which may be regarded as the superposition of a TE and a TM mode which exist only in a corrugated wall waveguide, is also referred to in this disclosure. Both the circular guide $HE_{1,1}$ mode and the rectangular $HE_{1,1}$ mode have very similar gaussian-like field patterns. Hence, for purposes of the present invention, a distinction need not be made between the circular and rectangular $HE_{1,1}$ modes.

The new generation of millimeter wavelength gyrotrons, having output frequencies greater than 100 GHz and output power greater than 500 kW operate in modes having large angular mode numbers. Modes having large angular mode numbers are frequently referred to in the literature as "whispering gallery" modes. This terminology is believed to be borrowed from acoustic, wave theory, and the known principle where low amplitude acoustic waves (i.e., a whisper) generated at one end of a properly designed acoustic gallery are reflected along the edges of the gallery, e.g. its walls and ceiling, to a focal point at the other end of the gallery, where such acoustic waves can be readily discerned. In a similar manner, a whispering gallery mode transfers, microwave energy through a waveguide or equivalent medium by maintaining all of the energy near the walls of the waveguide or other medium, leaving the center of the waveguide void of such energy.

Disadvantageously, a whispering gallery mode, such as the $TE_{15,2}$ mode provided by the Varian 140 GHz gyrotron, does not provide for the efficient transfer of high energy microwaves through a circular waveguide, over long distances, nor does it provide a radiation pattern of the microwave energy at the termination of the waveguide that allows such high energy to be efficiently used. High energy microwaves generated by millimeter wavelength gyrotrons are frequently used for radar or plasma heating applications that require the energy to be outside of the waveguide and focused or otherwise directed to a desired target or zone. It would thus be desirable if the high microwave energies in the waveguide could be directed to the desired target or zone by simply pointing or aiming the waveguide at the desired target or zone, much as a bullet in a gun is directed to a desired target by simply pointing or aiming the barrel of a gun at the target. Unfortunately, when the walls of the waveguide terminate, the microwave energy for most transmission modes, including transmission modes having a high angular mode number, has a conical pattern with a null on axis, thereby dramatically reducing the amount of energy that is received at any particular target point located a finite distance away from the end of the waveguide. What is needed, therefore, is a converter that converts the microwave energy while still within the waveguide to a mode that allows it to efficiently propagate upon termination of the waveguide to a desired target or zone.

For almost all purposes, from radar to plasma heating, it is desirable to radiate microwave energy with a pattern that has a single main lobe, with very little power in any side lobes, and with a well defined polarization. Such a radiation can be obtained using a free space mode that has a gaussian beam pattern that is directly radiated from the termination of the waveguide. Advantageously, such a free space gaussian beam is directly radiated from a corrugated waveguide propagating energy in the $HE_{1,1}$ mode. Hence, a waveguide-converter that generates the $HE_{1,1}$ mode from a whispering gallery or high order volume mode is needed for the efficient application of the new generation of millimeter wavelength gyrotrons referenced above.

One technique known in the art for converting whispering gallery modes to a beam of waves is described in Vlasov et al., "Transformation of a whispering gallery mode, propagating in a circular waveguide, into a beam of waves," *Radio Eng. and Electron Phys.,* Vol. 20, No. 10, pp. 14-17 (1975). Basically, this technique, described more fully below, utilizes a wide slot cut in the side wall of the waveguide. Because in the whispering gallery mode the energy is localized near the walls of the waveguide, and further because such energy is a rotating wave, the proper positioning of the slot allows this energy to exit the waveguide, whereupon a suitable focusing mirror is used to direct it to a desired target area.

It is noted that the desired target area of the Vlasov device could, of course, be another waveguide designed to propagate the power in a more efficient mode, such as the $HE_{1,1}$ mode. Such use of the Vlasov device presupposes, of course, that the energy passing out of the slot can be converted or transferred to the $HE_{1,1}$ mode in an efficient manner. Unfortunately, as indicated hereinafter, the conversion efficiency to a single mode from the whispering gallery mode using the Vlasov converter is inherently limited to no greater than about 80%. Such efficiency may not be acceptable for many applications.

SUMMARY OF THE INVENTION

In keeping with one aspect of the present invention, conversion from a whispering gallery or high order volume mode to a more useable mode, such as the rectangular waveguide $TE_{0,1}$ or $TE_{1,0}$ modes (which modes can be readily converted to the desired $HE_{1,1}$ mode), is achieved in a waveguide mode converter that includes an input section and an output section. The input section includes a circular waveguide and a coaxial waveguide, with the coaxial waveguide overlapping the circular waveguide. Microwave energy in a whispering gallery or high order volume mode, e.g., typically a $TE_{m,n}$ mode, where $m>10$ and $n\leqq 3$ (whispering gallery mode), or typically $m\geqq 6$ and $n\geqq 3$ (volume mode), is applied to the circular waveguide. An array of N equally spaced axial slots, placed in a common wall separating the circular waveguide and the coaxial waveguide in the region of overlap, couples energy from the circular waveguide $TE_{m,n}$ mode to coaxial $TE_{m',n'}$ modes, where $m'=m+pN$, and where $p=0$, $\pm 1$, $\pm 2$, etc. Helical grooves placed in one of walls of the coaxial waveguide convert the coaxial $TE_{m',n'}$ modes to a quasi parallel plate mode (with the equally spaced walls of the coaxial waveguide functioning as the parallel plates). (Note, as used herein, the term "parallel" means spaced apart an equal distance. Thus, two lines or planes that are equally spaced apart, even though the lines or planes may be curved, are considered to be parallel for purposes of the present invention.) The quasi parallel plate mode propagates energy spirally through the coaxial waveguide in a direction defined by a vector k. where k makes an angle $\theta$ to the waveguide axis. The helical grooves are placed transverse to k. Such grooves cause the normal modes to no longer be the coaxial TE and TM modes (TE and TM referring to the waveguide axis), but linear combinations thereof (modified by the presence of the grooves). One such linear combination is analogous to the desired parallel plate $TE_{0,1}$ mode, (transverse electric with respect to k) which normal mode is only slightly affected by the grooves. The other normal mode is analogous to the parallel plate $TM_{0,1}$ mode, which mode is strongly affected by the grooves. The grooves thus serve the function of selecting the desired $TE_{0,1}$ mode and deselecting the $TM_{0,1}$ mode.

The output section of the waveguide mode converter includes means for extracting the rectangular $TE_{0,1}$ energy by unwinding the "parallel plates" between which the energy is propagating in the helical direction (relative to the waveguide axis) in one turn of the helix, using a configuration that includes a gradual change in curvature (so as to avoid conversion to unwanted higher $TE_{m,n}$ modes) Once the curvature has been reduced to zero, the energy propagates in the true $TE_{0,1}$ parallel plate mode, and the interior grooves may be omitted, since in a straight waveguide they have no affect on the $TE_{0,1}$ mode.

In keeping with another aspect of the invention, the waveguide mode converter is made compact by reducing the length of its output stage. The length of the output stage is one turn of the helix. Advantageously, one parameter for controlling the pitch or tightness of this helix is the angular mode number m' of the transverse component of field in the angular direction of the coaxial mode. Thus, by making m' larger, which can be achieved, e.g., by increasing the number of equally spaced coupling slots N between the circular and coaxial waveguide, the length of the output stage may be reduced proportionally.

The waveguide mode converter can be made even more compact, in accordance with other embodiments of the invention, by employing appropriate mirrors or lenses in the output section. Such mirrors or lenses allow the dimensions of the output section waveguide cross section to be reduced and/or proportioned appropriately to facilitate the eventual conversion of the rectangular $TE_{0,1}$ mode to the $HE_{1,1}$ mode. Embodiments are disclosed, for example, that include the use of a sectoral horn in combination with such lenses or mirrors for converting the $TE_{0,1}$ mode available at the output section waveguide, which output section waveguide is an enlarged rectangular waveguide, to the $TE_{0,1}$ mode in a more conventional sized rectangular waveguide. One such embodiment folds the output stage, and incorporates a mirror at the fold, thereby further reducing the overall dimensions of the converter.

Thus, in summary, the present invention relates generally to a mode converter that efficiently converts microwave energy from a whispering gallery mode (or other mode having a high angular mode number) to a more useable mode (e.g., one having a low angular mode number) using a configuration that is shorter and more compact than prior art devices. Various embodiments of the invention are contemplated.

In keeping with yet another aspect of the invention, the angular mode number of microwave energy applied to circular waveguide is increased as the microwave energy is coupled to a coaxial waveguide. The coupling is realized using a mode converter that resembles the "input section" of the waveguide mode converter described above. That is, a section of coaxial waveguide overlaps a section of circular waveguide. An array of N equally spaced axial slots in the common wall between the two waveguides in the region of overlap provides the coupling mechanism.

One feature of the present invention provides a mode converter wherein the local fields everywhere in the waveguide can be represented by a single normal mode of the local conductor cross section, thereby avoiding undesirable diffraction.

A further feature of the invention provides a circular whispering gallery to rectangular $TE_{0,1}$ waveguide mode converter that is overall shorter than the converters of the prior art for the same input waveguide diameter. The shortness of the present converter results from avoiding use of the long cylindrical mirrors of the prior art converters, and further because the angular mode number of the microwave energy may be selectively increased using the present invention as the microwave energy is coupled from the input circular waveguide to an intermediate coaxial waveguide. Such increase in angular mode number causes the microwave energy propagating in the intermediate coaxial waveguide to propagate in a tighter spiral (increased pitch) than does microwave energy having a lower angular mode number. As it takes one turn of the spiralling helix to extract such energy, the overall length of such turn is reduced when a tighter spiral is employed.

A related feature of the invention facilitates the conversion of the rectangular $TE_{0,1}$ mode output of such a converter to an $HE_{1,1}$ mode, thereby providing an overall conversion from a whispering gallery mode to the $HE_{1,1}$ mode.

A further feature of the invention provides a waveguide mode converter apparatus wherein the critical elements thereof are independent, and can therefore be tested separately, thereby improving the manufacturability of the apparatus.

Yet another feature of the invention provides a means for changing the angular mode number of microwave energy coupled between circular and coaxial waveguides.

BRIEF DESCRIPTION OF THE DRAWINGS

The above and other aspects, features and advantages of the present invention will be more apparent from the following more particular description thereof, presented in conjunction with the following drawings wherein:

FIG. 3A is an end view of the ray paths inside a circular waveguide, and is used to help understand the operation of the Vlasov converter as well as the present invention;

FIG. 3B is a sketch depicting the basic prior art Vlasov converter;

FIGS. 4A, 4B and 4C are respective sketches showing the ray paths of the basic Vlasov converter inside the unfolded cylinder;

FIG. 5A is a cross sectional view of a coaxial waveguide and shows the coaxial waveguide geometry;

FIGS. 5B and 5C are side and end views, respectively, of one embodiment of the present invention, which embodiment includes the use of circular (hollow) and coaxial waveguides, with coupling therebetween, and a helically grooved outer conductor of the coaxial waveguide;

FIGS. 6A and 6B are side and end views, respectively, of an output "unwrapping" section of a further embodiment of the present invention, which output section converts a coaxial input, such as is obtained from the embodiment of the invention shown in FIGS. 5B and 5C, to an oversize rectangular $TE_{0,1}$ mode output;

FIG. 7 depicts one manner of matching the oversized rectangular $TE_{0,1}$ mode output shown in FIG. 6A to a sectoral horn by means of a 90° curved mirror in the E plane;

FIGS. 8A and 8B show top and side views, respectively, of an alternative embodiment for matching the rectangular $TE_{0,1}$ mode output shown in FIG. 6A to a sectoral horn by means of a dielectric lens vacuum window;

FIGS. 9A and 9B show top and side views, respectively, of yet another embodiment for matching the rectangular $TE_{0,1}$ mode output shown in FIG. 6A to a sectoral horn by means of a 180° H plane bend which is curved in the E plane to form a folded mirror; and FIG. 9C shows a partial sectional view taken along the line C—C of FIG. 9B.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1A:
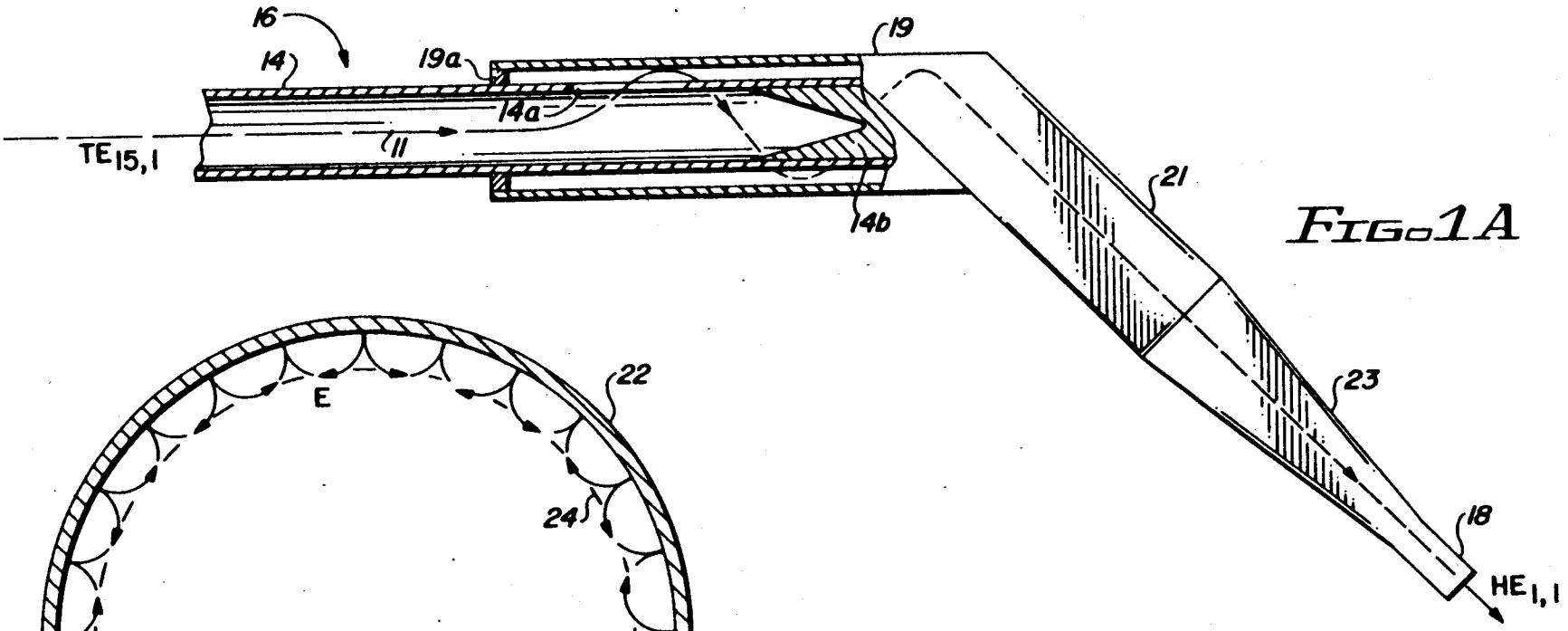
FIG. 1A is a schematic diagram of one embodiment of the present invention.

Referring first to FIG. 1A, a schematic diagram is shown illustrating the basic components of a mode converter 16 made in accordance with one embodiment of the present invention. This embodiment converts microwave energy of a whispering gallery mode, e.g., the $TE_{15,1}$ mode, applied to an input circular waveguide 14 to the $HE_{1,1}$ mode at an output waveguide 18. The manner in which this conversion occurs is described more fully below, but basically the conversion process proceeds as follows: The microwave energy in the whispering gallery mode propagates through the circular waveguide 14 in the direction indicated by the dotted line 11 in conventional manner. A coaxial waveguide 19 overlaps a portion of the circular waveguide 14. A plurality of axial slots **14*a*, only one of which is shown in the schematic diagram of FIG. 1A, provide a coupling through which the microwave energy in the circular waveguide 14 is coupled to the coaxial waveguide 19. An absorbent matched termination 14*b* closes off the circular waveguide 14 after the region of the slots 14*a*. A suitable concentric plug 19*a* also closes the coaxial waveguide 19 at its end. A plurality of spiralling grooves, not shown in FIG. 1A, on the inner side of the outer wall of the coaxial waveguide 19, in combination with the geometry of the axial slots 14*a*, cause the coupled microwave energy to propagate through the coaxial waveguide in accordance with a quasi parallel plate mode that follows a spiraling or helical path. A section of this coaxial waveguide 19 is "unwound" in alignment with this spiraling direction of propagation, transforming the quasi parallel plate mode to a rectangular $TE_{0,1}$ mode in the process. An additional converter 23 is then used to convert the rectangular mode to the $HE_{1,1}$ mode, which mode is transmitted through an output waveguide 18**.

Figure 1B:
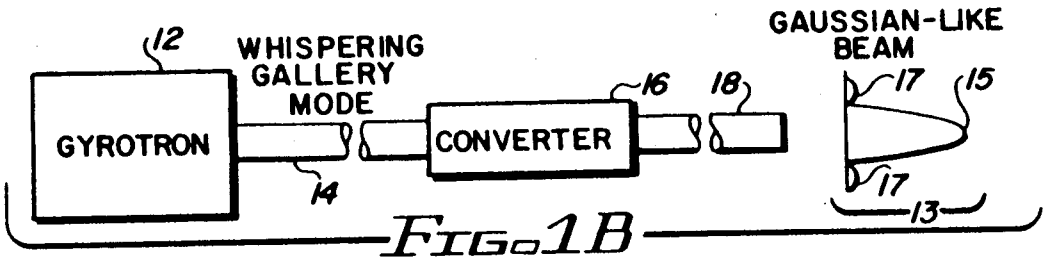
FIG. 1B is block diagram illustrating one manner in which the converter of FIG. 1A may be used.

FIG. 1B shows a basic block diagram of a typical application for the converter shown in FIG. 1A. A gyrotron 12 generates microwave energy at a high power level, e.g., >500 kW, and a high frequency, e.g., >100 GHz. Such energy is confined to the waveguide 14, which waveguide propagates the energy therethrough in accordance with a transmission mode having large angular mode numbers, which modes are often called whispering gallery modes. (Whispering gallery modes are employed to alleviate cathode current density limitations and mode competition problems within or near the gyrotron.) For almost all applications, from radar to plasma heating, it is desirable to radiate a desired target or area with the energy radiating from the end of an output waveguide 18 exhibiting a free space mode that is a gaussian beam. A sketch of a radiation pattern 13 of such a beam is included in FIG. 1B. As seen in the sketch of the desired radiation pattern 13, the gaussian beam advantageously exhibits a single main lobe 15, with very little power in any side lobes 17. Further, the beam exhibits a well defined polarization. Unfortunately, however, the whispering gallery mode present in the waveguide 14 does not exhibit this desired radiation pattern upon termination of the waveguide.

Further, the whispering gallery mode cannot generally transmit the energy over long distances with low loss. Thus, the waveguide mode converter 16, built in accordance with the present invention, is used to receive the energy from the gyrotron 12 through the waveguide 14, convert the energy to an appropriate alternate mode, such as the $HE_{1,1}$ mode, for propagation through an output waveguide 18 to the desired target area. When the $HE_{1,1}$ mode is used within the waveguide 18, and when the output waveguide 18 is a corrugated waveguide, the desired gaussian beam radiates directly from the end of the corrugated waveguide.

Thus, it is seen that a basic function of this embodiment of the present invention is to convert energy from the gyrotron 12, which energy typically exhibits a large angular mode number in the waveguide at the output of the gyrotron, to a waveguide transmission mode more compatible with a free space gaussian beam radiation. Because the technique for converting from the fundamental $TE_{0,1}$ rectangular waveguide mode to such a mode exhibiting free space gaussian beam radiation (e.g., $HE_{1,1}$ mode) is well known, the function of this embodiment of the present invention reduces to converting a whispering gallery mode, or other mode having a high angular mode number (such as a volume mode), to the rectangular $TE_{0,1}$ mode, or equivalent, from which mode the desired $HE_{1,1}$ mode can readily be obtained.

Other embodiments of the invention perform other functions. For example, one embodiment of the invention may be viewed as simply the "input section" of the converter shown in FIG. 1A, i.e., a circular to coaxial waveguide converter that provides controlled flexibility in the angular mode number of the output energy. This feature is explained more fully below. For now, it suffices to note that although the invention is described in terms of its overall function and structure, other embodiments of the invention may be found in the individual elements of the structure.

Figure 2:
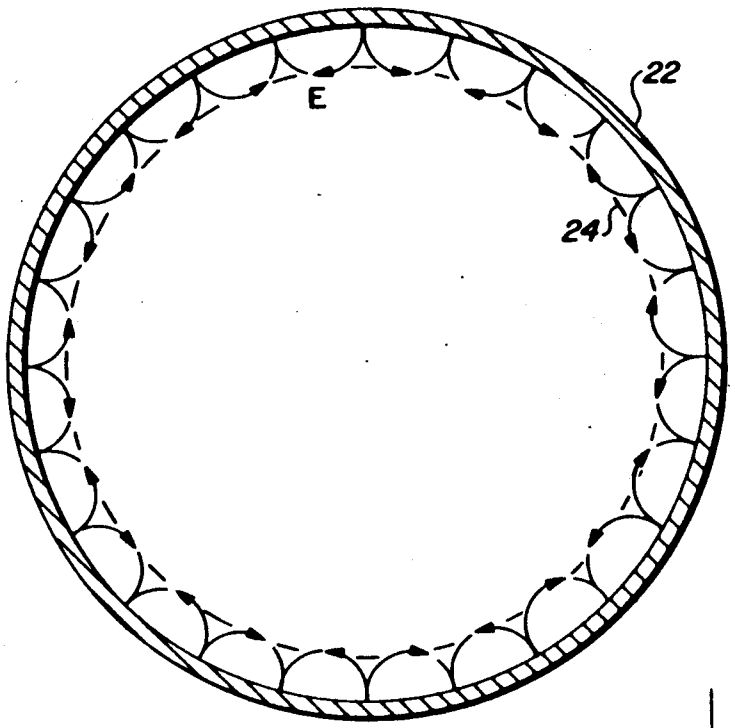
FIG. 2 illustrates a whispering gallery mode by showing a cross section of a circular waveguide with the electric field distribution of a $TE_{15,1}$ mode being depicted.

To better understand how the invention performs this overall function, it will first be helpful to describe a whispering gallery mode and provide a brief description of the approach used in the prior art for converting a whispering gallery mode to an alternative mode. Hence, reference is next made to FIG. 2 where there is shown a cross sectional view of a circular waveguide 22 having microwave energy propagating therethrough in a whispering gallery mode. The particular whispering gallery mode shown in FIG. 2 is a $TE_{15,1}$ mode, although it is to be understood that this particular mode is only exemplary of a whispering gallery mode. (In general, a whispering gallery mode is considered as any mode where the angular mode number m is much larger than the radial mode number n.)

As seen in FIG. 2, the electrical field distribution of a whispering gallery mode, represented by the lines 26, is concentrated very near the wall 22. A caustic line 24 defines the approximate boundary of the electrical field. Thus, there is a large zone within the center of the waveguide 22 where no electrical field is present. A $TE_{m,2}$ whispering gallery mode would have the electrical field distribution extend further towards the center of the waveguide 22, but there would still remain a large void near the center of the waveguide where negligible electrical field is present.

It is also important to recognize that the output of the gyrotron is a rotating wave. That is, for these modes, $$B_r \propto E_\phi \propto J'_m(P'_{m,n}r/a)\exp[i(m\phi+k_z z)],$$

where, assuming polar coordinates for the cross-section of the waveguide, with the waveguide cylindrical axis lying in the z direction, $B_r$ is the radial magnetic field strength, $E_\phi$ is the angular electric field strength, $J'_m$ is the derivative of the Bessel function $J_m$, and $J'_m(P'_{m,n})=0$, r is the radial coordinate, a is the radius of the waveguide, $k_z$ is the axial wave number, and m is the angular mode number. Likewise, $$B_\phi \propto B_z \propto E_r J_m(P'_{m,n}r/a)\exp[i(m\phi+k_z z)]$$

where $B_\phi$ is the angular magnetic field strength, $B_z$ is the axial magnetic field strength, $E_r$ is the radial electric field strength, and the other variables are as defined above. These expressions illustrate, just as with a rectangular waveguide, that the wave propagation may be viewed in terms of rays reflecting off the waveguide wall. From an end view, the rays appear to skip around the waveguide wall as shown in FIG. 3A. Note in FIG. 3A that the lines 32 and 33 represent ray paths inside of the circular guide 22, with the dashed line 33 representing the path of a ray having a slightly different phase than a ray following the path 32. The rays are, of course, also travelling in the axial (z) direction simultaneously. Here, $k_\perp = P'_{m,n}/a$ so that $k_z=\sqrt{(\omega/c)^2-k^2_\perp}$, $\omega/2\pi$ is the applied frequency, c is the velocity of light, and $k_\phi = m/a$. Then a quantity $k_r$ may be defined by $k_r=\sqrt{k^2_\perp-(m/a)^2}$, so that $k_z^2+k_\phi^2+k_r^2=(\omega/c)^2$.

From FIG. 3A, it can be seen from a simple geometry that if an angle $\alpha$ is defined by $\cos\alpha = k_\phi/k_\perp = m/P'_{m,n}$, then the skip angle of the rays is just $2\alpha$. Hence, if an opening 34 is made in the wall 22, through which the rays are to escape, the size of the opening need be just the skip angle, $2\alpha$. Since the rays are travelling helically at an angle $\theta$ to the axial direction, where $\tan\theta = k_\phi/k_z$, the rays all pass through the opening in one circuit around the circumference.

FIG. 3B schematically depicts the manner in which one prior art device, described in the aforecited Vlasov reference (hereafter the "Vlasov" device), incorporates the opening 34 in the side of a circular waveguide 22 for the purpose of extracting the energy therefrom. A mirror 36 is positioned near the opening 34 for the purpose of reflecting the energy in a desired direction towards a target area 38, which area 38 may be the input of another waveguide where a more preferred mode of transmission is excited. In this manner, the energy confined to the region near the walls of the waveguide 22 (i.e., energy propagating in the waveguide in accordance with a whispering gallery mode) may be redistributed within the target area 38, and excite a more preferred mode of transmission.

That all the rays pass through the opening 34 in one circuit around the circumference of the waveguide 22 is best shown in FIGS. 4A, 4B and 4C taken from the previously cited Vlasov reference. These figures show the cylindrical waveguide 22 (FIG. 4A), having the opening 34 therein, and further show the ray paths inside the waveguide 22 by unfolding the waveguide 22 (FIG. 4B). FIG. 4C depicts the operative portions of the waveguide 22. The axial distance for one circuit around the circumference is just $$L=2\pi R^2 k_z/m$$

where R is the radius of the waveguide shown in FIGS. 4A and 4B.

The limitation on the conversion efficiency of the Vlasov device comes from the fundamental relation between the field distribution at an aperture and the resulting radiation pattern from it. It is clear in the case of the Vlasov device that the radiation profile is constant over the length of the opening, with an abrupt drop to zero at each end, in which case the radiation pattern is not at all gaussian, but rather is given by the $(\sin x/x)^2$ function, which means that 10% of the power is outside the main lobe. Likewise, in the transverse direction, the fields rise abruptly at the first edge seen by the rays, leading to a similar behavior. In addition, for the $TE_{m,2}$ modes, there is an additional dip in the main lobe, as taught in the Vlasov reference. Once these side lobes are produced, there is a fundamental restriction on making them part of the main beam, at least by optical means. While it is, of course, possible, to design a mirror that will make the side lobes cross the main lobe, a single mode would not be excited in a waveguide from such a source distribution. Hence, it is evident that while the Vlasov device successfully extracts the energy away from a whispering gallery mode, it does so at the expense of power that is lost by diffraction.

The diffraction loss of the Vlasov device can be avoided either by radiating a smooth profile, such as a sine distribution, or by insuring that the fields can everywhere be represented by a normal mode of the local cross section. By requiring that the output beam be simply a low order normal mode of a metallic waveguide, rather than one which has a sine distribution of field in both the E and H planes, the task (of reducing diffraction loss) is greatly simplified.

An important aspect of the present invention is to provide a waveguide converter that uses this approach of reducing diffraction loss, i.e., that requires the output beam to be a low order normal mode of a metallic waveguide. As explained above in connection with FIG. 1A, the waveguide converter of the present invention converts the whispering gallery or volume mode of an input circular waveguide to the $TE_{0,1}$ mode in an oversized rectangular waveguide. The oversized rectangular waveguide is then reduced to a suitably sized rectangular waveguide, whereupon conventional conversion means, as already referenced, may be used to convert to the desired $HE_{1,1}$ mode.

The output of the Vlasov device, described above in conjunction with the description of FIGS. 3 and 4, cannot be the normal mode of a metallic waveguide because the aperture illumination is uniform along the magnetic field direction (axial), and metal walls cannot be placed in planes that are perpendicular to the magnetic field direction. Hence, the output of the Vlasov device cannot couple to a single normal mode of a metallic waveguide. What is needed for coupling to a single normal mode of a metallic waveguide is an output beam having a transverse magnetic field component exhibiting a sine profile, i.e., varying from zero at the walls to a maximum value at a center point equidistant from the walls, while the electric field component may exhibit a step profile.

One mode that has this desired property is the $TE_{0,1}$ parallel plate mode described in Marcuvitz, supra. in that the transverse component of B (the magnetic field) is perpendicular to the parallel plates, and therefore has the desired sine profile, while E (the electric field) is parallel to the conductors and may take a step profile if terminated by appropriate conductors. The parallel plate mode also has an axial component of B along the propagation vector k, which may have any orientation in the plane of the plates. Advantageously, this mode is a relatively low loss mode for plate spacings of just 1–2λ (where λ is the wavelength) because the conductors, i.e., the parallel plates, correspond to the narrow walls of the fundamental $TE_{0,1}$ rectangular guide.

While the parallel plate mode is only truly a normal mode of straight parallel plate conductors, it has an analogue in coaxial geometry, where it is referred to herein as a quasi parallel plate mode. Such coaxial geometry is shown in FIG. 5A, where a cross section of a coaxial waveguide 40 is shown. The coaxial waveguide 40 includes an inner cylinder 42 and an outer cylinder 44, the outer cylinder 44 having a radius a and the inner cylinder 42 having a radius b. More precisely, because the walls of the cylinders have a finite thickness, the radius a is hereafter defined as the distance from the shared longitudinal axis 46 of the cylinders (shown in FIG. 5A as a point) to the inside of the outer wall 44, and the radius b is defined as the distance from the longitudinal axis 46 of the cylinders to the outside of the inner wall 42. The spacing between the inner and outer walls, a−b, is thus equidistant and is the spacing that corresponds to the distance between the parallel plates of a true (straight) parallel plate mode, as described, e.g., in Marcuvitz, supra.

The $TE_{0,1}$ mode becomes only a normal mode for the coaxial geometry in the limit that $a/b \rightarrow 1$. This is because the $TE_{m,2}$ and $TM_{m,1}$ modes, as defined in Marcuvitz, supra, at pages 74–78, become degenerate as $a/b \rightarrow 1$, and can therefore be superimposed to form the parallel plate mode, in which the propagation vector k makes an angle $\theta$ to the cylindrical (longitudinal) axis. The angle $\theta$ is defined by $\tan \theta = k_\phi / k_z$, where $k_\phi = 2m/(a+b)$ is the azimuthal propagation constant, and $K_z$ is the axial propagation constant, respectively.

Advantageously, when $a/b > 1$, this quasi parallel plate mode can be maintained by helically grooving at least one of the conductors, i.e., by grooving either the exterior of the inner wall 42 or the interior of the outer wall 44, transverse to k with grooves having a depth of λ/4 and with a period along k less than λ/2. (e.g., λ/3). With such grooves, the normal modes are no longer the coaxial $TE_{m,2}$ and $TM_{m,1}$ modes; rather, new normal modes are formed that are linear combinations of them (modified by the presence of the grooves). One of these new normal modes resulting from this linear combination is the desired $TE_{0,1}$ mode, which mode is only slightly affected by the grooves. The other new normal mode is analogous to the parallel plate $TM_{0,1}$ mode, which is strongly shifted in propagation velocity by the grooves. Hence, the grooves have the effect of selecting the $TE_{0,1}$ mode, and deselecting the $TM_{0,1}$ mode. These modes would otherwise be nearly degenerate in the coaxial geometry, and truly degenerate in the parallel plate case.

Referring next to FIGS. 5B and 5C, a preferred embodiment of an input section of the present invention is shown in a partially cutaway side view (FIG. 5B) and an end sectional view (FIG. 5C). A circular waveguide 50 serves as an input waveguide for receiving the microwave energy in the whispering gallery mode (or other mode having a high angular index). This circular or hollow waveguide 50 is surrounded by a larger diameter circular waveguide 52 that is coaxial with the circular waveguide 50. Where the waveguide 52 overlaps the waveguide 50, a coaxial waveguide 54 is thus formed comprising the outer circular waveguide 52 and the inner circular waveguide 50'. (Note, the waveguide 50' is simply the extension of the waveguide 50. The reference numeral 50' thus represents that portion of the waveguide 50 that is overlapped or surrounded by the outer waveguide 52. The wall 50' of the waveguide thus functions as a common wall shared between the circuit waveguide and the coaxial waveguide in the region of overlap.) The inner radius of the circular waveguide 50 (and, hence, also the inner radius of the waveguide 50') is a'. The spacing between the outer wall of the waveguide 50' and the inner wall of the waveguide 52 is (a−b), the same as was described in FIG. 5A. The thickness of the common wall is b−a'.

An array of axial slots 58 are placed in the wall of the waveguide 50' in order to couple the energy from the circular waveguide 50 to the coaxial waveguide 54. Advantageously, these axial slots do not couple to the TM modes in the circular waveguide, thereby easing any mode competition problems that might otherwise exist within the circular waveguide 50'. The slots 58, which are equally spaced around the circumference of the waveguide 50', couple the circular waveguide TE modes, e.g., the circular whispering gallery $TE_{m,n}$ mode, to the coaxial $TE_{m',n'}$ modes where $m'=m+pN$, with N being the number of equally spaced slots 58 and p being equal to 0, ±1, ±2, etc.

The manner of determining the slot width and length of the axial slots 58 (and hence the amount of overlap needed between the circular and coaxial waveguides) will now be explained. In the description that follows, reference should be made to FIGS. 5B and 5C for a definition of many of the parameters that are used.

Based on arguments similar to those used for calculating the slot coupling in U.S. Pat. No. 4,704,589, the required uniform length of the coupling slots is $$L = \frac{\pi}{\Delta\beta_z},$$

where $\Delta\beta_z$ is the difference in the axial wavenumbers of the even and odd modes, assuming the two waveguides originally had equal values of $\beta_z$ in the absence of coupling, and where the even and odd modes are the true normal modes of the coupled waveguides considered as a whole. If the transverse wavenumber $\beta_\perp$ is defined by $\beta_z^2+\beta_\perp^2=\omega^2/c^2$, then $\Delta\beta_z \approx -(\beta_{\perp 0}/\beta_{z0})\Delta\beta_\perp$, where $\beta_{\perp 0}$ and $\beta_{z0}$ are the values in the absence of coupling. Then defining $l=b-a'$ (the common wall thickness), $\beta_{\perp 0} l=(2q-1)\pi/2$ for optimum coupling, where q is a positive integer, as in the above-mentioned patent. Letting $\beta_\perp=\beta_{\perp 0}+\delta/l$, then $\Delta\beta_\perp=2\delta/l$, where δ can be expressed in the form:

$$\delta^2=H_1H_2d^2/[1+(H_1+H_2)d] \tag{1}$$

where $$H_1 = -\frac{N}{2\pi}\ \frac{1}{a'}\ \frac{l}{a'}\ G_1 \tag{2a}$$

and $$H_2 = -\frac{N}{2\pi}\ \frac{1}{b}\ \frac{l}{b}\ G_2 \tag{2b}$$

Here, d is the slot width and N the number of equally spaced slots, and $G_1$ and $G_2$ are related to the wall current per unit power flow and are given by $$G_1 = \frac{[\sin(m_1d/2a')/(m_1d/2a')]^2}{(m_1/\beta_{\perp 0}a')^2 - 1} \tag{3a}$$

and $$G_2 = \frac{[\sin(m_2d/2b)/(m_2d/2a')]^2}{(m_2/u)^2 - 1 - (m_2^2 - v^2)(\pi/2)^2 Z^2_{m2(u,v)}} \tag{3b}$$

where $u=\beta_{\perp 0}b$ and $v=\beta_{\perp 0}a$ and $Z_m(u,v)=J_m(u)\ Y'_m(v)-Y_m(u)\ J'_m(v)$, and where $Y_m(v)$ is the Bessel function of the second kind of order m, and $Y'_m(v)=dY_m(v)/dv$.

The assumption that the uncoupled guides have equal $\beta_{\perp 0}$ values implies $dJ_{m1}(x)/dx=0$ for $x=\beta_{\perp 0}a'$ for the hollow waveguide and $\partial Zm_2(u,v)/\partial u=0$ for $u=\beta_{\perp 0}b$ and $v=\beta_{\perp 0}a$ for the coaxial waveguide. The equations in fact determine $\beta_{\perp 0}$, given a', a, b, and $m_1$, $n_1$ and $m_2$, and $n_2$. Usually the arguments for the sin functions are $<<1$ so that the sin(x)/x terms are very close to 1. Therefore, $G_1$ and $G_2$ are independent of b, the slot width.

As a numerical example of the manner in which slot width and length are determined, assume $\omega/2\pi=110$ $GH_z$, a'=2.54 cm, b=3.08 cm and a=3.505 cm; so l=0.54 cm; with the hollow (circular) guide mode being $TE_{15,2}$, the coaxial mode being $TE_{15,2}$ (no change in angular mode numbers), and with the number of slots, N, being 60. Then $G_1=-1.849$ and $G_2=7.40$.

For the structure to have any mechanical integrity, the slots should not occupy more than half the circumference, so let d=0.133 cm. That gives δ=0.247 or $\Delta\beta_\perp=0.913\ cm^{-1}$ and $\beta_{z0}=21.333\ cm^{-1}$, so that $\Delta\beta_z=0.372\ cm^{-1}$, making L=8.44 cm for complete transfer.

The above is for the case of smooth walls, while the wall of radius a' is in fact spirally grooved. That has no significant effect on the values of $\beta_\perp$ and $\beta_z$ for the parallel plate mode in the above case; but it changes slightly the magnitude of $B_z$, the axial magnetic field, at the coupling wall. The quantity $G_2$ has to be multiplied by $B^2_z$(grooved)/$B^2_z$(smooth), assuming unit power in both cases. That ratio is 0.87 in the above case, which makes δ=0.235 and L=8.85 cm.

As indicated in the previously referenced patent (4,704,589), in order to avoid coupling to other modes, it is desirable to taper the coupling slot width, narrowest at the ends and widest in the center. In that case, full coupling is achieved when $$\int_{-L/2}^{L/2} \Delta\beta_z\, dz = \pi \tag{4}$$

The dependence of $\Delta\beta_z$ on z may, for example, be of the form $\Delta k_z=C_0\cos(\pi Z/L)$, where $C_0=\pi^2/2L$ to satisfy equation (4). Then, δ is determined by $2\delta/l=\Delta\beta_\perp=(\beta_{z0}/\beta_{\perp 0})\ \pi^2/2L\ \cos(\pi z/L)$; and d is determined as a function of z by solving equation (1) for d. Since $H_1$ and $H_2$ are essentially independent of d, this is easily done, once L is chosen.

The value of L is generally determined not by the widest slot that structural integrity allows but rather on the basis of avoiding coupling to some other mode, such as another coaxial mode with the same angular dependence as the desired mode, such as the $TM_{01}$ parallel plate mode. If the axial wavenumber of the desired mode is $\beta_{z0}$, and the axial wavenumbers of the undesired mode $\beta'_{z0}$, the minimum tapered coupling length is $$L \geqq \frac{4\pi}{\beta_{z0} - \beta'_{z0}} \quad (5)$$

For the numerical example given above, $\beta_{z0}=21.325$ while $\beta'_{z0}=22.268$, requiring L to be $L \geqq 13.33$ cm.

Still referring to FIGS. 5B and 5C, it is seen that equally spaced grooves 60 are placed in the interior side of the outer wall 52 so as to immediately convert the coaxial $TE_{m',n'}$ mode to a quasi parallel plate mode. The grooves 60 follow a helical pattern that is oriented so that the grooves are perpendicular to the direction of propagation k of the energy in the parallel plate mode. These grooves 60, for the embodiment shown in FIGS. 5B and 5C, are shown already present in the coupling region near the slots 58, so that the true normal modes correspond to the quasi parallel plate TE and TM modes. (That is, these TE and TM modes are the only modes allowed to exist.) The axial slots 58 couple to both mode types (TE and TM), because transverse electric (TE) and transverse magnetic (TM) refer, in the quasi parallel plate case, to the direction of propagation k, not to the cylindrical axis. However, because of the grooves in the outer conductor, the TE and TM parallel plate modes, for example, have significantly different phase velocities, unlike the case of smooth conductors where they would be degenerate. Hence, by choosing a−b properly, and for a given N (the number of slots), the TE mode can be selected by matching its phase velocity to that of the input mode in the circular guide. Thus, in the quasi parallel plate mode, the microwave energy, once coupled through the axial coupling slots 58, propagates in a spiraling direction (relative to the cylindrical axis), through the space bounded by the curved parallel plates that comprise the walls of the conductors 50' and 52.

An alternative approach places the coupling slots in a common wall of a first region of a coaxial waveguide, thereby coupling to the, e.g.; coaxial $TE_{m',2}$ mode, and then gradually introducing grooves to convert to the quasi parallel plate mode. However, because the coaxial mode has substantially higher losses than the parallel plate mode, it is preferred to begin with the grooves already present at the point of coupling, as shown in FIGS. 5B and 5C, thereby effectively transferring energy to the quasi parallel plate mode directly without passing through an intermediate $TE_{m',n'}$ coaxial mode.

Another alternative approach which will work for $TE_{m,2}$ modes if no change in angular mode number is required, is to taper from a hollow to coaxial waveguide. For a $TE_{m,2}$ mode in a circular guide of radius a, the fields are negligible at a radius <a/2, so a center conductor can be introduced with radius <a/2 without perturbing the fields and then tapered to the required final radius b. To mimimize ohmic losses it would be advantageous to introduce the helical grooves into the outer conductor before introducing the center conductor.

Based on the parallel plate model, it can be shown that the cutoff wavenumber for the desired TE mode is approximately $k_c^2=[\pi/(a-b)]^2+[2m'/(a+b)]^2$. Since the axial slots preserve $k_z$, $k_c$ must equal the cutoff wavenumber for the input $TE_{m,n}$ mode. Thus, $k_c=P'_{m,n}/a'$.

As a further numerical example, consider a $TE_{15,2}$ input mode at 110 GHz in the hollow waveguide 50 at twice the cutoff diameter (which gives $k_z=19.95\ cm^{-1}$) and with 36 equally spaced coupling slots (i.e., N=36). To couple to a desired m'=21 mode, a−b is selected to be 0.40 cm, assuming $(a+b)/2 \approx 2.5$ cm. Because only the outer conductor 52 is grooved, the competing TM-like modes have $k_c^2=[q\pi/2(a-b)]^2+[2m'/(a+b)]^2$, where q is an odd integer. The closest interfering mode has q=1 with m'=15 (which is also unavoidably coupled), and has $k_z=18.87\ cm^{-1}$. The beat wavelength between these modes is therefore 5.8 cm. The minimum coupling length is one beat wavelength for uniform coupling or two beat wavelengths for tapered coupling, if the inferfering mode is to be avoided. It would be possible, of course, to reduce the required slot length by reducing m' (and therefore reducing a−b and increasing the separation of the modes), but the allowable tolerance on a−b would also become smaller.

If there is a gradient in the spacing $g=a-b$ transverse to k, such a gradient causes the rays to bend in the plane of the plates with a radius $\rho$, where $1/\rho=(1/k)(dk/dt)=[\pi^2/(k^2g^3)](dg/dt)$ and where t is a coordinate transverse to k and the plane of the conductors.

Such bending is generally undesirable, but due to manufacturing tolerances, may be unavoidable. For example, assuming a gradient of 0.002 cm/cm, and g=0.4 cm, $\rho=15.2$ m, which means, if the gradient were to persist for 1 cm, the deflection of the rays would be $3\times10^{-4}$ cm or $\lambda/800$. In the usual case, the bending will be less, since the average gradient along the path due to random errors should be close to zero.

With the quasi parallel plate mode established, i.e., with the microwave energy spirally propagating in the parallel plate mode through the region bounded by the curved parallel plates, it remains to unwrap the coaxial region so that the microwave energy can be extracted. This unwrapping may be best visualized by thinking of the grooved coaxial waveguide as a spiraling rectangular waveguide that is wrapped around a core that is the extension of the inner circular waveguide 50, with the energy propagating through this spiraling rectangular waveguide in a $TE_{0,1}$ mode. The top or outer plate of this spiraling rectangular waveguide is the outer cylinder 52 of the coaxial waveguide 54. The bottom or inner plate of this rectangular waveguide is the inner cylinder 52' of the coaxial waveguide. The side walls of this spiraling rectangular waveguide do not really exist, but such side walls could exist without interfering with the propagation of the energy in the $TE_{0,1}$ mode provided they follow the spiral path and are therefore normal to the local electric field lines and parallel to the local magnetic field lines. Energy is extracted from the spiralling rectangular waveguide by simply unwrapping the waveguide from its core in one turn.

More precisely, and with reference to FIGS. 6A and 6B, which figures illustrate the side and end views of the output section of the present invention, it is seen that the energy propagates in the coaxial waveguide 54 in accordance with a linear combination of the $TE_{m',2}$ and $TM_{m',1}$ modes (which combination produces the spiralling quasi parallel plate mode described above). Since the transverse (to k) magnetic field is now radial, this mode is not perturbed by a conducting surface or partition 62 that is perpendicular to the coaxial conductors and locally parallel to k, where k is the direction of propagation of the quasi parallel plate mode. Such a surface or partition is a helical sheet. This partition thus turns the coaxial guide 54 into a helically wound $TE_{0,1}$ mode rectangular waveguide, with the curvature in the H plane. This rectangular waveguide may then be unwound, as shown in FIGS. 6A and 6B, to form a straight rectangular waveguide 64, having a guide height w. As known to those skilled in the art, if the coaxial geometry is such that the parameter (a−b) is larger than the free space wavelength λ, then the change in curvature should be in principle gradual to avoid unintended mode conversion to higher $TE_{0,n}$ modes. See, e.g., Doane, J. L., and Anderson, T. N., "Oversized Rectangular Waveguides With Mode-Free Bends and Twists for Broad Band Applications," *Microwave Journal,* Vol. 32, No. 3, p. 153 (March 1989). It has been found however, by a numerical solution of the exact equations, that even for $a-b \approx 1.5\lambda$, there can be negligible mode conversion even for an abrupt transition to zero curvature. Hence, the fabrication of the converter may be greatly simplified.

Once the curvature has been reduced to zero, the interior grooves may be omitted, since in a straight waveguide they have no affect on the $TE_{0,1}$ mode. The length L of this unwound rectangular waveguide is just one turn of the helix, which length can be expressed as $$L=2\pi[(a+b)/2]^2 k_z/m'.$$

Recall that m' is the angular mode number of the quasi parallel plate mode propagating in the coaxial waveguide when viewed as a rotating mode propagating axially. This value can be set to a desired value by adjusting the number of axial coupling slots N. Thus, advantageously, by making m' larger, L is reduced proportionally, and the parameter (a−b), the distance between the inner and outer surfaces of the coaxial waveguide, can be made larger, thereby improving the manufacturability of the guide.

One of the aspects of the invention is not only to convert a whispering gallery mode to a more useable mode, such as the rectangular $TE_{0,1}$ mode, but also to convert the energy to a mode, such as the $HE_{1,1}$ mode, that produces a desired pencil beam radiation pattern upon termination of the guide. To achieve this, the $TE_{0,1}$ mode must be converted to the $HE_{1,1}$ mode, which task is vastly easier if the guide height w is substantially reduced. For the configuration shown in FIG. 6A, $$\begin{aligned} w &= L/\sin(\theta) \\ &= \pi(a+b)k_z/\sqrt{(\omega/c)^2-\pi^2/(a-b)^2} \\ &< \pi(a+b). \end{aligned}$$

Given the numerical values presented above, it can thus be shown that L=37.3 cm and w=14.5 cm. With such a highly overmoded waveguide, a nonlinear taper used to reduce the height w would be impractically long. Hence, an alternative means for reducing the guide height is needed.

The approach proposed here is to match the overmoded waveguide to a more conventional waveguide by making the wavefront cylindrical, thereby allowing the desired reduction of the waveguide height to be realized using a conventional sectoral horn, with the cylindrical wave being the normal mode of the horn.

While any suitable means may be employed to make the wavefront cylindrical, three means are described herein. A first, shown in FIGS. 8A and 8B, utilizes a lens 70 to interface directly with the output of the enlarged rectangular waveguide 64. A sectoral horn 72 is attached just after the lens 70. The sectoral horn terminates at its small end with a non-linear taper 75, which non-linear taper may be a reasonable length prior to terminating with a nominal-sized output rectangular waveguide 74, from which point it can be converted to the desired $HE_{1,1}$ mode using conventional means.

The configuration shown in FIGS. 8A and 8B is especially well suited for applications where the converter is used as part of a gyrotron, in which case the vacuum window used as part of the gyrotron could be the lens.

Alternatively, a mirror may be used in place of the lens, in which case the dielectric losses and resulting cooling problems associated with a dielectric lens may be avoided. One type of mirror that may be used, for example, is shown in FIG. 7. In FIG. 7, a 90° E plane curved mirror 76 is employed between the output of the enlarged rectangular waveguide 64 and the sectoral horn 72. While such a geometry does not properly satisfy the boundary conditions for the E field in the reflector region unless w is large, thereby leading to some loss, the amount of loss may be tolerable for some applications. For example, based on the results presented by Quine, J. P., "Oversize Tubular Metallic Waveguides", *Microwave Power Engineering,* Vol. 1 (Academic Press, New York, ed. E. C. Okress, 1968), the mode conversion loss for a plane mirror is on the order of $\approx 1.96(\lambda/w)^{\frac{1}{2}}$ dB, which for the example given above is a loss of 0.27 dB. The loss from a curved mirror would be somewhat less than this value.

A still further configuration that may be used to achieve the desired results, and that is more compact and efficient than the configurations depicted in FIGS. 7 and 8, is illustrated in FIGS. 9A, 9B and 9C. FIGS. 9A and 9B show top and side views, respectively, of this compact configuration, while FIG. 9C shows a partial sectional view taken along the line 9C—9C of FIG. 9B. This configuration matches the enlarged rectangular waveguide 64 (unwound from the coaxial waveguide 54) to a nominal-sized rectangular waveguide 74 by way of a 180° H plane bend that is curved in the E plane to form a folded mirror 78, and an E-plane sectoral horn 80.

As seen in FIGS. 9A–9C, the configuration there illustrated takes advantage of the small (a−b) dimension, and includes the folded mirror 78 as an essential element. The folded mirror 78 is preferably a parabola with its focus a distance R from a vertex 82. Such an arrangement imparts a wave front to the propagating energy that also has a radius of R. Hence, the sectoral horn must come to a point a distance R from the mirror 78. Fortunately, it is possible to make a sharp bend in the H plane because of the small (a−b) dimension. If $(a-b)<\lambda$, the 180° bend need only be a few λ long. Thus, with a short taper to this smaller size (of a few λ), followed by the 180° bend, and with a taper back to the original value; the fold may be compact and simple to make. Alternatively, the curvature into and out of the 180° bend can be tapered, as suggested in Doane and Anderson, supra, in which case the value of (a−b) can remain constant, but the manufacture of the bend may be more difficult. Alternatively, if (a−b) is tapered to be $<1.5\lambda$, only two modes can propagate, and a bend radius can be chosen for any given frequency and (a−b) value for which the mode conversion is negligible.

The ohmic loss in the taper need not present a problem. At the input to the taper, for the numerical example presented above, (a−b)=0.4 cm and w=20 cm, while the output might be chosen as 3.2 cm×3.2 cm. Assuming the tapers inbetween are approximately linear, the total loss would be approximately 0.8% for a 1 meter long taper, with the highest dissipation occurring near the ends.

With any of the configurations shown in FIGS. 7-9, the small end of the sectoral horn tapers into a rectangular guide by means of the non-linear taper 75. This non-linear taper is needed since the new guide height w′ is still large compared to λ. The (a−b) dimension is tapered to a larger size within the sectoral horn to reduce the power density at the small end of the horn. After w is reduced to w′, a conversion to the rectangular $HE_{1,1}$ mode, as taught, e.g., by Doane, J. L., "Low Loss Propagation in Corrugated Rectangular Waveguide at 1 mm Wavelength", *International Journal of Infrared and Millimeter Waves* 8, p. 13 (1975), can readily be made through the use of a tapered corrugation of the H plane walls, upon which the E field terminates.

One advantage of the mode converter described herein is its ability to not only convert microwave energy from a whispering gallery mode, but also to convert energy from a volume mode, such as the $TE_{6,4}$ mode of the Thomson CSF 100GH$_z$ gyrotron. This conversion is made possible because of the ability to increase the angular mode number in the input section as the energy is coupled from the circular waveguide to the coaxial waveguide Hence, the $TE_{6,4}$ mode in the circular waveguide may be converted, e.g., to a $TE_{20,2}$ mode in the coaxial waveguide, whereupon grooves are used as described above to convert the energy to a quasi parallel plate TE mode.

Advantageously, the overall conversion efficiency of the converter described herein may be as great as 95%, including ohmic losses. This represents a significant improvement over prior art devices, especially when one realizes that the present converter may be more compact than prior art converters and the output is in a single waveguide mode.

While the invention herein disclosed has been described by means of specific embodiments and applications thereof, numerous modifications and variations could be made thereto by those skilled in the art without departing from the scope of the invention set forth in the claims.

What is claimed is:

1. Waveguide mode converter apparatus for converting microwave energy from a whispering gallery mode to a single rectangular waveguide mode having low mode numbers, said apparatus comprising:

a circular waveguide;

a coaxial waveguide overlapping a portion of said circular waveguide, a common wall separating said circular waveguide from said coaxial waveguide;

means for applying microwave energy in a whispering gallery mode to the circular waveguide;

means for coupling the microwave energy in the whispering gallery mode in said circular waveguide to a corresponding coaxial transmission mode in the coaxial waveguide, said coupling means including an array of N equally spaced axial slots placed in said common wall, where N is an integer;

means for converting the microwave energy in said coaxial transmission mode within said coaxial waveguide to a quasi parallel plate mode, said microwave energy propagating in accordance with said quasi parallel plate mode along a spiral path through said coaxial waveguide, said coaxial waveguide having inner and outer walls that function as parallel plates that are wrapped to form said circular waveguide, said quasi parallel plate mode exhibiting an electric field that is transverse to the spiraling direction of propagation and parallel to the walls of said coaxial waveguide, and further exhibiting a magnetic field having a component transverse to the spiraling direction of propagation that is perpendicular to the inner and outer walls of said coaxial waveguide, said means for converting including helical grooves on the inside of the outer wall of said coaxial waveguide, said helical grooves being oriented to run transverse to said spiral path;

means for extracting said microwave energy in said quasi parallel plate mode from said coaxial waveguide, said extracting means including means for helically unwinding the walls of said coaxial waveguide to form a rectangular waveguide, said quasi parallel plate mode becoming a rectangular waveguide mode within said rectangular waveguide;

whereby microwave energy within said whispering gallery mode is converted to microwave energy in said rectangular waveguide mode.

2. The waveguide mode converter apparatus set forth in claim 1 further including second conversion means for converting the microwave energy in said rectangular waveguide from said rectangular waveguide mode to the $HE_{1,1}$ mode, said $HE_{1,1}$ mode providing a gaussian beam that propagates from an end of said second conversion means.

3. The waveguide mode converter apparatus set forth in claims 1 or 2 further including waveguide matching means for matching said rectangular waveguide to a specified waveguide configuration, said matching means including a sectoral horn that is interposed between the rectangular waveguide and the specified waveguide configuration.

4. The waveguide mode converter apparatus set forth in claim 3 wherein the number N of axial slots in said common wall is selected to increase the angular mode number of the coaxial transmission mode over the angular mode number of the whispering gallery mode in said circular waveguide, said increased angular mode number allowing the length of a helically unwinding section to be shorter, thereby rendering the apparatus more compact.

5. The waveguide mode converter apparatus set forth in claim 3 wherein said matching means includes a parabolic cylindrical mirror connecting said rectangular waveguide to said sectoral horn.

6. The waveguide mode converter apparatus set forth in claim 3 wherein said matching means includes a 180° folded mirror that couples said rectangular waveguide to said sectoral horn.

7. Waveguide mode converter apparatus comprising:

a circular waveguide;

a coaxial waveguide overlapping a portion of said circular waveguide, a common wall separating said circular waveguide from said coaxial waveguide;

an array of N equally spaced axial slots placed in said common wall, where N is an integer, microwave energy in a first transverse electric mode within said circular waveguide being converted to a second transverse electric mode within said coaxial waveguide through said axial slots, said first transverse electric mode propagating in said circular waveguide in a longitudinal direction, said second transverse electric mode propagating in said coaxial waveguide along a spiral path.

8. The waveguide mode converter apparatus as set forth in claim 7 wherein said first transverse electric mode comprises a $TE_{m,n}$ circular waveguide mode, where m and n are integers.

9. The waveguide mode converter apparatus as set forth in claim 8 wherein said first coupling means further includes means for converting the microwave energy coupled through said axial slots to a quasi parallel plate mode within said coaxial waveguide, the inner and outer walls of said coaxial waveguide functioning as parallel plates between which said microwave energy is confined, said parallel plates being wrapped about a cylindrical axis of said coaxial waveguide, said parallel plate mode exhibiting an electric field that is transverse to said spiral path and parallel to said parallel plates.

10. The waveguide mode converter apparatus as set forth in claim 9 further including helical grooves on the inside of the outer wall of said coaxial waveguide, said helical grooves being oriented so as to be transverse to said spiral path, said helical grooves having a depth of $\lambda/4$, where $\lambda$ is the wavelength of the microwave energy.

11. Waveguide mode converter apparatus for converting microwave energy from a whispering gallery or volume mode to a rectangular $TE_{0,1}$ mode comprising:

first conversion means including an input circular waveguide section coupled to an output coaxial waveguide section for converting microwave energy applied to said input circular waveguide section to an intermediate TE mode that spirally propagates through said output coaxial waveguide section, said output coaxial waveguide section having inner and outer curved walls that are parallel to each other;

second conversion means for converting said intermediate TE mode from said coaxial waveguide section to said rectangular $TE_{0,1}$ mode, said second conversion means including an aperture in the outer wall of said coaxial waveguide section through which microwave energy in said spirally propagating intermediate TE mode may pass, and a curved parallel plate waveguide section to said aperture for collecting the microwave energy passing through said aperture, said curved parallel plate waveguide section gradually curving and forming a straightened section of rectangular waveguide wherein the microwave energy propagates in said $TE_{0,1}$ mode.

12. The waveguide mode converter apparatus as set forth in claim 11 further including third conversion means coupled to the straightened section of rectangular waveguide for further converting said microwave energy from said rectangular $TE_{0,1}$ mode to an $HE_{1,1}$ mode.

13. The waveguide mode converter apparatus as set forth in claim 11 wherein said intermediate TE mode has an electric field that is transverse to the spiraling direction of propagation of said microwave energy and substantially parallel to the inner and outer curved walls of said output coaxial waveguide section, and further wherein the output coaxial waveguide section includes means for attenuating the wall current flow in the spiral direction of propagation of said coaxial waveguide.

14. The waveguide mode converter apparatus as set forth in claim 13 wherein said means for attenuating the wall current flow in the spiral direction of propagation includes grooves placed on the inside of the outer wall of said coaxial waveguide section, said grooves being placed so as to be transverse to the spiralling direction of propagation of said intermediate TE mode, said grooves thereby following a helical path that is transverse to the spiralling direction of propagation of the microwave energy through said output coaxial waveguide section, said helical grooves further having a fixed spacing therebetween.

15. The waveguide mode converter apparatus as set forth in claim 12 wherein said third conversion means includes a sectoral horn section that matches the straightened section of enlarged rectangular waveguide to a second waveguide section, said second waveguide section having dimensions compatible with a specified waveguide.

16. The waveguide mode converter apparatus as set forth in claim 15 wherein said sectoral horn section includes a dielectric lens vacuum window therein.

17. The waveguide mode converter apparatus as set forth in claim 15 further including a parabolic cylindrical mirror that couples said enlarged rectangular waveguide section to said sectoral horn section.

18. The waveguide mode converter apparatus as set forth in claim 15 further including a 180° folded mirror section that couples said enlarged rectangular waveguide section to said sectoral horn section, whereby a longitudinal axis of said sectoral horn section lies adjacent to and substantially parallel to a corresponding longitudinal axis of said enlarged rectangular waveguide section.

19. A method for converting microwave energy from a whispering gallery mode applied to an input circular waveguide section to a $TE_{0,1}$ mode in an output rectangular waveguide section comprising the steps of:

coupling the microwave energy in said input circular waveguide section to an intermediate coaxial waveguide section that is coaxial with said input circular waveguide section, said intermediate coaxial waveguide section having inner and outer curved walls that are parallel to each other and coaxial with said circular waveguide section, said coupling being performed in a manner that causes the microwave energy coupled to said intermediate coaxial waveguide section to spirally propagate through said intermediate coaxial waveguide section in an intermediate TE mode;

converting said intermediate TE mode in said coaxial waveguide section to said $TE_{0,1}$ mode in said output rectangular waveguide section by placing an aperture in the outer wall of said coaxial waveguide section through which microwave energy in said spirally propagating intermediate TE mode may pass, and coupling a curved parallel plate waveguide section to said aperture, collecting the microwave energy passing through said aperture, and gradually curving said curved parallel plate waveguide section to form said output rectangular waveguide section in which said microwave energy propagates in said $TE_{0,1}$ mode.

20. The method of claim 19 further including the step of converting said microwave energy from said $TE_{0,1}$ mode to an $HE_{1,1}$ mode.

21. The method of claim 19 further including the step of matching the output rectangular waveguide section containing the microwave energy in said $TE_{0,1}$ mode to a second rectangular waveguide using a sectoral horn.

22. The method of claim 21 wherein the step of matching using a sectoral horn includes folding the output rectangular waveguide using a 180° folded mirror and coupling the folded waveguide to said sectoral horn.

23. The method of claim 21 wherein the step of matching using a sectoral horn includes coupling the output rectangular waveguide to said sectoral horn using a parabolic cylindrical mirror.

24. The method of claim 21 wherein the step of matching using a sectoral horn includes inserting a dielectric lens vacuum window at the interface of said output rectangular waveguide and said sectoral horn.

25. A method for making a microwave energy converter that converts microwave energy between a circular waveguide and a coaxial waveguide, said method comprising the steps of:

overlapping a portion of a circular waveguide with a coaxial waveguide, there being a common wall separating the circular waveguide from the coaxial waveguide;

inserting an array of N equally spaced axial slots in said common wall; and placing helical grooves on the inside of the outer wall of said coaxial waveguide.

26. Waveguide mode converter apparatus comprising:

a circular waveguide;

a coaxial waveguide overlapping a portion of said circular waveguide, a common wall separating said circular waveguide from said coaxial waveguide, an array of N equally spaced axial slots placed in said common wall, where N is an integer; and helical grooves on the inside of said coaxial waveguide;

microwave energy propagating in a first transverse electric mode in said circular waveguide being coupled to said coaxial waveguide through said axial slots and converted to a second transverse electric mode.

27. The waveguide mode converter apparatus as set forth in claim 26 wherein the first transverse electric mode comprises a $TE_{m,n}$ circular waveguide mode and the second transverse electric mode comprises a $TE_{m',n'}$ coaxial waveguide mode, where m and n are integers, and further wherein m' is related to m as a function of the number of axial slots N, whereby the number of axial slots N may be used to control the value of m' of the second transverse electric mode to which the microwave energy is converted.

28. Waveguide mode converter apparatus for converting microwave energy propagating in a first mode having a first angular mode number to a selected second mode having a second angular mode number comprising:

a circular waveguide;

a coaxial waveguide overlapping a portion of said circular waveguide, a common wall separating said circular waveguide from said coaxial waveguide;

helical grooves on the inside of said coaxial waveguide;

an array of N equally spaced axial slots placed in said common wall, where N is an integer, microwave energy being coupled through said axial slots from one of said circular or coaxial waveguides to the other, the second angular mode number being determined by the number of axial slots N in accordance with a prescribed relationship;

whereby said selected second angular mode number of said second mode is controlled by selecting the number of axial slots N placed in said common wall.

29. The waveguide mode converter apparatus as set forth in claim 28 wherein said first angular mode number is m, and said second angular mode is m', and wherein the prescribed relationship that determines the angular mode number m' is $$m' = m + pN$$

where p assumes the values of $$p = 0, \pm 1, \pm 2, \ldots$$

and N is the number of axial slots.

30. A method of changing the angular mode number of microwave energy coupled between circular and coaxial waveguides comprising:

overlapping a portion of a circular waveguide with a coaxial waveguide, there being a common wall separating the circular waveguide from the coaxial waveguide in the overlapped portion;

placing a prescribed number N of equally spaced axial slots in said common wall;

placing helical grooves on the inside of an outer wall of said coaxial waveguide in the portion of overlap; and coupling microwave energy through said axial slots between said circular and coaxial waveguides;

the angular mode number being changed as a function of the number N of equally spaced axial slots.

* * * * *

UNITED STATES PATENT AND TRADEMARK OFFICE

CERTIFICATE OF CORRECTION

PATENT NO. : 5,030,929

DATED : 7/9/91

INVENTOR(S) : Moeller, Charles

It is certified that error appears in the above-identified patent and that said Letters Patent is hereby corrected as shown below:

IN OTHER PUBLICATIONS (title page): 2nd Ref., under "Smith, Robert B." change "Solution" to --Solutions--.

IN THE SPECIFICATION: Column 1, line 61, delete "," (comma). Column 3, line 54, after "modes)" insert --.-- (period). Column 8, line 1, change "$J_m(P_{m,n}$" to --$J'_m(P'_{m,n}$-- to make prime sign more definite; line 12, change "$E_rJ_m(P_{m,n}$" to --$E_r\alpha J_m(P'_{m,n}$-- to add $\alpha$ between $E_r$ and $J_m$ and to make prime sign in $P'_{m,n}$ more definite. Column 9, line 19, delete "," (comma) (third occurrence). Column 11, line 8, change "circuit" to --circular--; line 51, change "1 = b-a'" to --$\ell$ = b-a'--; line 67, delete "-" (minus sign) in front of "$N/2\pi$" in equation 2(b). Column 12, line 14, replace hyphen (-) at end of line with a right parenthesis; line 15, delete right parenthesis at beginning of line; line 29, change "1" to --$\ell$--; line 60, change "$2\delta/1$" to --$2\delta/\ell$--.

UNITED STATES PATENT AND TRADEMARK OFFICE

CERTIFICATE OF CORRECTION

PATENT NO. : 5,030,929

DATED : 7/9/91

INVENTOR(S) : Moeller, Charles

It is certified that error appears in the above-identified patent and that said Letters Patent is hereby corrected as shown below:

Column 17, line 35, after "waveguide" insert --.-- (period).

Signed and Sealed this

Second Day of February, 1993

*Attest:*

STEPHEN G. KUNIN

*Attesting Officer*

*Acting Commissioner of Patents and Trademarks*